United States Patent [19]

Rapp et al.

[11] 4,105,880

[45] Aug. 8, 1978

[54] ARC BLOW-OUT SWITCH

[75] Inventors: Günter Rapp, Kassel-Be; Marcel Celestin Konrad, Kassel-Wilh, both of Fed. Rep. of Germany

[73] Assignee: Licentia Patent-Verwaltungs-G.m.b.H., Frankfurt am Main, Fed. Rep. of Germany

[21] Appl. No.: 758,870

[22] Filed: Jan. 12, 1977

[30] Foreign Application Priority Data

Jan. 20, 1976 [DE] Fed. Rep. of Germany ..... 2601857

[51] Int. Cl.[2] ..... H01H 33/88

[52] U.S. Cl. ..... 200/148 A

[58] Field of Search ..... 200/148 A, 150 G

[56] References Cited

U.S. PATENT DOCUMENTS

| | | | |
|---|---|---|---|
| 2,850,600 | 9/1958 | Prince | 200/148 A |
| 2,913,556 | 11/1959 | Leeds | 200/148 A |
| 3,872,272 | 3/1975 | Yoshioka | 200/148 A |
| 3,895,202 | 7/1975 | Okerman et al. | 200/148 A |

*Primary Examiner*—Robert S. Macon

*Attorney, Agent, or Firm*—Spencer & Kaye

[57] ABSTRACT

An arc blow-out switch is formed of a plurality of extinguishing units arranged in tandem, each including a movable compression cylinder and a stationary compression piston arranged in the compression cylinder. Axially aligned insulating cylinders surround each extinguishing unit. The arc blow-out switch further has a rod arrangement disposed within the insulating cylinders and connected to the compression cylinders for moving the latter as a unit to effect circuit making and circuit breaking operations.

5 Claims, 3 Drawing Figures

ARC BLOW-OUT SWITCH

BACKGROUND OF THE INVENTION

This invention relates to a piston-type arc blow-out switch that includes a plurality of serially (tandem) arranged extinguishing units, for example, three per pole. The blow-out switch has, in a superposed relationship in insulating cylinders, several identical extinguishing chambers (switch unit modules) with movable compression cylinders and stationary compression pistons. The compression cylinders are driven, during switch actuation, by means of at least one actuator rod made of an insulating material.

In switches of the above-outlined type, all serially arranged switch units have to be simultaneously actuated with the application of a large force (for example, by means of a hydraulic drive) during the circuit breaking operation. During this operation the extinguishing (blow-out) medium which is usually $SF_6$, is compressed prior to the contact separation proper. The movable compression cylinders and the switch contacts of the individual switch units are, for this purpose, coupled with an actuator rod made of an insulating material, while the compression pistons remain stationary with respect to the switch housing. During the circuit breaking operation a pulling force is exerted on the actuator rod, while during the circuit making operation a pressing force is exerted thereon. The individual switching chambers are usually surrounded by cylinders made of an insulating material for protecting the metallic switch housing against the arc generated during the circuit breaking operation.

A metal-encased switch of the above-outlined type is described, for example, in BROWN-BOVERI-MITTEILUNGEN, 1974, Vol. 4, page 157 (Bulletin issued by the Swiss firm Brown-Boveri). In the circuit breaker disclosed in this publication, the individual switch units are driven by a relatively thick actuator rod which is guided laterally externally of the switching chambers that are enclosed in the insulating cylinders. The actuator rod is composed of individual length portions having identical diameters. For effecting a mechanical connection of the actuator rod with the movable compression cylinders there are provided connecting elements which project through openings in the insulating cylinders. The actuator rod and the connecting elements are exposed, in addition to tension and pressure, to bending stresses as well. Consequently, they must have a non-changing large diameter or, as the case may be, should be tubular components.

SUMMARY OF THE INVENTION

It is an object of the invention to provide an improved switch (circuit breaker) of the above-outlined type in which the disadvantages of the prior art structures, that is, a relatively large weight and the exposure of the actuator rods and the connecting elements to bending stresses are avoided.

These objects and others to become apparent as the specification progresses, are accomplished by the invention, according to which, briefly stated, the arc blow-out switch is formed of a plurality of switch units arranged in tandem, each including a movable compression cylinder and a stationary compression piston arranged in the compression cylinder. Axially aligned insulating cylinders surround each switch unit. The arc blow-out switch further has a rod arrangement disposed within the insulating cylinders and connected to the compression cylinders for moving the latter as a unit to effect circuit making and circuit breaking operations.

DESCRIPTION OF THE PREFERRED EMBODIMENT

Figure 1:
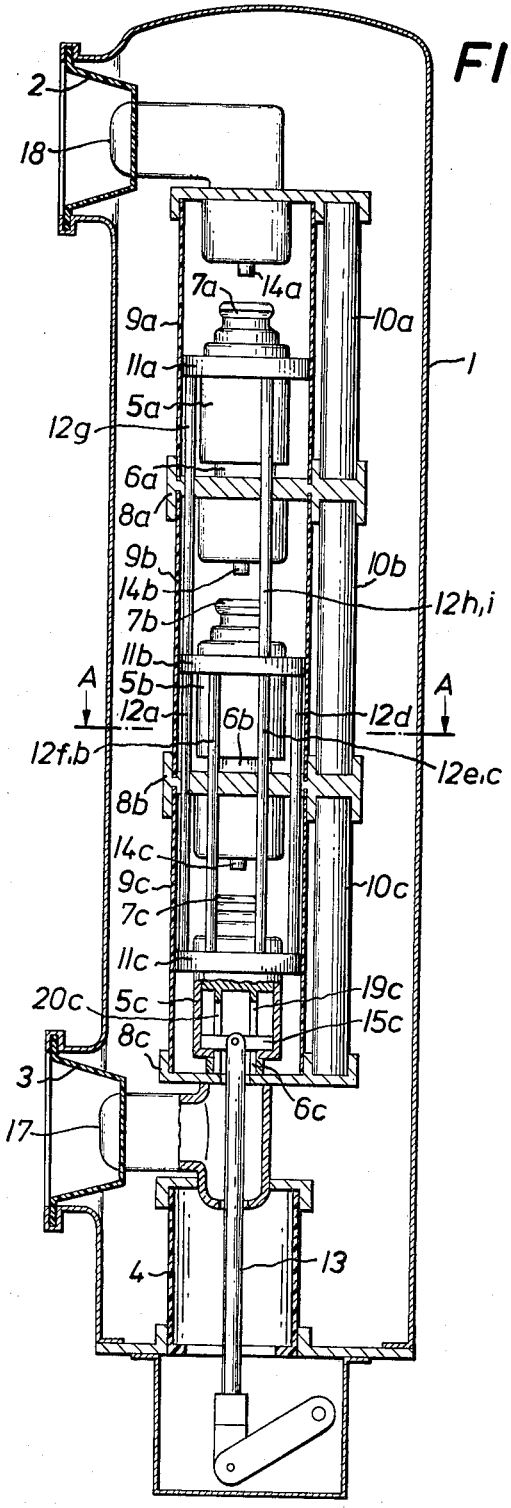
FIG. 1 is a schematic longitudinal sectional view of one pole of a metal-encased, piston-operated arc blow-out switch with three tandem arranged extinguishing units according to a preferred embodiment of the invention.

Turning now to FIG. 1, the pole of a circuit breaker switch shown therein has a metal casing 1 in which between two terminals 17, 18 there are disposed three serially connected identical extinguishing units which are supported by insulators 2, 3 and 4.

Each of the three extinguishing units essentially comprises a stationary compression piston 6*a*, 6*b* and 6*c*, respectively, disposed in respective movable compression cylinders 5*a*, 5*b* and 5*c*. To the movable compression cylinder, within a respective insulating nozzle 7*a*, 7*b* and 7*c*, there is attached the respective movable arc contact (not shown). During the circuit breaking operation an arc is drawn between the movable arc contact and the respective stationary arc contact 14*a*, 14*b* and 14*c*. The compression pistons are supported by respective metallic intermediate components 8*a*, 8*b* and 8*c* into which there are inserted, with their peripheral edge portions, respective insulating cylinders 9*a*, 9*b* and 9*c*, surrounding the switch units. Laterally of the insulating cylinders there are arranged respective condensers 10*a*, 10*b* and 10*c* for bridging the individual switch units. The compression cylinders 5*a*, 5*b* and 5*c* each have annular enlargements 11*a*, 11*b* and 11*c*, respectively.

The compression cylinders 5*a*, 5*b* and 5*c* are moved in unison either downwardly (circuit breaking operation) or upwardly (circuit making operation) by a switch drive with the intermediary of actuator rods 12*a* – 12*i* and 13 (all made of an insulating material) now to be described in more detail. The actuator rod 13 is connected at one end to the switch drive while its other end is affixed to the inside of the movable compression cylinder 5*c*.

As shown in FIG. 1, the rod 13 penetrates the hollow terminal 17 and is hinged to a short horizontal bar 15*c*. The ends of the bar 15*c* are fixed at the inside of the compression cylinder 5*c*. In order to provide space for the bar 15, the compression piston 6*c* is fitted with two vertical gaps 19*c*, 20*c*.

The actuator rod 13 is made of an insulating material and is of sufficiently robust structure (its outer diameter is greater than that of any of the rods 12*a* – 12*i*) to safely withstand the total compression or pulling forces exerted thereon during the switching operations.

Figure 2:
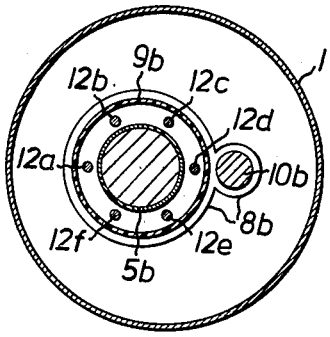
FIG. 2 is a schematic sectional view taken along line A—A of FIG. 1.

Also referring now to FIG. 2, six parallel arranged, circumferentially evenly distributed actuator rods 12*a*, 12*b*, 12*c*, 12*d*, 12*e* and 12*f* are, at their ends, fixedly attached to the annular enlargements 11*b* and 11*c* to thus provide a force transmitting means between compression cylinders 5*b* and 5*c* of the central and lowermost switch units, respectively. Further, three actuator rods 12*g*, 12*h* and 12*i* (the latter is hidden behind the actuator rod 12*h* in FIG. 1) are affixed at their ends, in a parallel arranged, circumferentially evenly distributed manner, to the annular enlargements 11*a* and 11*b* to thus provide a force transmitting means between the compression cylinders 5*a* and 5*b* of the uppermost and the central switch units, respectively. The actuator rods 12*g* – 12*i* may be axially aligned, respectively, with every other actuator rod 12*a* – 12*f*. It is thus seen that the actuator rod assembly 12*a* – 12*i* which is arranged within the axially aligned insulating cylinders 9*a*, 9*b* and 9*c*, brace the movable compression cylinders 5*a*, 5*b* and 5*c* into a rigid unit which is movable in unison by the actuator rod 13. The number of actuator rods is expediently reduced between the central and uppermost switching units with respect to the number between the central and lowermost units since the latter, being closer to the switch drive, is exposed to larger stresses than the former. This feature, as well as the circumferentially even distribution of the actuator rods 12*a* – 12*i* ensures a uniform mechanical loading of these components.

The actuator rods 12*a* – 12*f* pass through corresponding openings provided in the intermediate support component 8*b*, while the actuator rods 12*g* – 12*i* pass through corresponding openings provided in the intermediate support component 8*a*.

For the circuit breaking operation, all rods 12*a* – 12*i* and 13 are exposed to a tension stress, whereas for the circuit making operation a compression stress (which is smaller than the tension stress) is imparted thereon. It is seen that, in contradistinction to the prior art as disclosed, for example, in the Brown-Boveri publication referred to before, the rods, by virtue of their particular arrangement, are not exposed to any bending torque.

Tests have shown that the performance of the tandem switch units is not affected by the bridging actuating rods 12*a* – 12*i*.

In order to protect the actuating rods 12 during heavy-duty switching operations against the effects of an arc, they can be surrounded with an envelope or a sleeve made of heat-resistant synthetic material, for example, polytetrafluoroethylene.

Figure 3:
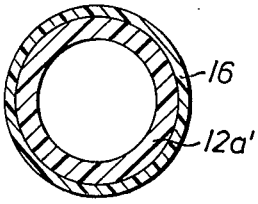
FIG. 3 is a schematic sectional view of a turbular actuator rod.

It is further feasible to make the actuating rods 12 tubular. Such a structure has a higher dielectric strength than rods of solid cross section, because they contain less inhomogenities. In FIG. 3, as an alternate solution such a tubular actuating rod 12*a*′ is shown. It is coated with a sleeve 16 of heat resistant material.

It will be understood that the above description of the present invention is susceptible to various modifications, changes and adaptations, and the same are intended to be comprehended within the meaning and range of equivalents of the appended claims.

What is claimed is:

1. In an arc blow-out switch having a central switch unit and two outer switch units arranged in tandem; means for supporting the switch units; each switch unit including a movable compression cylinder and a stationary compression piston arranged in the compression cylinder; axially aligned insulating cylinders surrounding each switch unit; actuator rod means connected to the compression cylinders for moving them as a unit to effect circuit making and circuit breaking operations, and a switch drive arranged adjacent one of the outer switch units for driving the actuator rod means; the improvement wherein said actuator rod means couple said switch drive to the compression cylinders of the three switch units and comprise a total of six actuator rods each affixed to the compression cylinder of said one of said outer switch units and to the compression cylinder of said central switch unit; said actuator rod means further comprising a total of three actuator rods each affixed to the compression cylinder of said central switch unit and the compression cylinder of the other of said outer switch units.

2. An arc blow-out switch as defined in claim 1, wherein said actuator rod means further comprises an additional actuator rod attached to said switch drive and affixed to the compression cylinder of said one of said outer switch units.

3. An arc blow-out switch as defined in claim 1, wherein said six actuator rods are arranged in a parallel-spaced, even circular distribution between said one of said outer switch units and said central switch unit; said three actuator rods being arranged in a parallel-spaced, even circular distribution between said central switch unit and the other of said outer switch units.

4. An arc blow-out switch as defined in claim 1, wherein said actuator rods are coated with a heat resistant layer, made of a synthetic material.

5. In an arc blow-out switch having a plurality of switch units arranged in tandem; means for supporting the switch units; each switch unit including a movable compression cylinder and a stationary compression piston arranged in the compression cylinder; axially aligned insulating cylinders surrounding each switch unit; actuator rod means connected to the compression cylinders for moving them as a unit to effect circuit making and circuit breaking operations, and means for driving the actuator rod means; the improvement wherein said actuator rod means comprise actuator rods arranged between the switch units; all said actuator rods being tubular.

* * * * *